US005924373A

United States Patent [19]

Tomita et al.

[11] Patent Number: 5,924,373

[45] Date of Patent: Jul. 20, 1999

[54] ELECTRONIC SEWING MACHINE CONTROL HAVING NUMERIC KEYS ON DISPLAY

[75] Inventors: Shintaro Tomita; Akira Hayakawa, both of Nagoya, Japan

[73] Assignee: Brother Kogyo Kabushiki Kaisha, Nagoya, Japan

[21] Appl. No.: 09/145,271

[22] Filed: Sep. 2, 1998

[30] Foreign Application Priority Data

Sep. 22, 1997 [JP] Japan ..... 9-275225

[51] Int. Cl.[6] ..... D05B 21/00; D05C 5/02

[52] U.S. Cl. ..... 112/102.5; 112/445; 112/458

[58] Field of Search ..... 112/102.5, 445, 112/456, 458, 454, 470.06, 470.04, 457; 340/825.36, 815.53; 345/141

[56] References Cited

U.S. PATENT DOCUMENTS

| | | | |
|---|---|---|---|
| 4,688,503 | 8/1987 | Kato . | |
| 4,819,573 | 4/1989 | Bisson et al. | 112/454 |
| 4,901,656 | 2/1990 | Yoshida | 112/445 X |
| 5,044,291 | 9/1991 | Kobayashi et al. | 112/458 X |
| 5,074,232 | 12/1991 | Matsubara | 112/454 X |
| 5,228,403 | 7/1993 | Sugimoto . | |
| 5,427,044 | 6/1995 | Hirabayashi | 112/445 X |
| 5,710,545 | 1/1998 | Dunn | 340/825.36 |

FOREIGN PATENT DOCUMENTS

| | | |
|---|---|---|
| A-62-101283 | 5/1987 | Japan . |
| B2-1-26317 | 5/1989 | Japan . |
| A-3-289990 | 12/1991 | Japan . |
| A-7-39662 | 2/1995 | Japan . |

*Primary Examiner*—Peter Nerbun
*Attorney, Agent, or Firm*—Oliff & Berridge, PLC

[57] ABSTRACT

An electronically controlled embroidery sewing machine has a liquid crystal display and a control unit having a ROM. The ROM stores display data for displaying ten numeric keys representing numbers of 0–9. The display is provided with a touch panel having several touch keys. The numeric keys corresponding to the touch keys are displayed in a numeric key display area of the display. For selection of a desired embroidery pattern, a number corresponding to the desired pattern is selected by pressing the touch keys, and the selected number is displayed in a number display area of the display in half-size and in reversed contrast, followed by the desired pattern. Thus, a selecting operation of the desired embroidery pattern is simplified, and need for extra numeric buttons or an extra space for the numeric buttons is eliminated, resulting in reduction in the size and cost of the display as well as the sewing machine.

20 Claims, 5 Drawing Sheets

ELECTRONIC SEWING MACHINE CONTROL HAVING NUMERIC KEYS ON DISPLAY

CROSS REFERENCE TO RELATED APPLICATION

This application relates to and incorporates herein by reference Japanese Patent Application No. Hei. 9-275225 filed on Sep. 22, 1997.

BACKGROUND OF THE INVENTION

1. Field of the Invention

The present invention relates to a sewing machine control capable of embroidering, and more particularly to a display control for the sewing machine which displays ten numeric keys representing numbers 0–9 so that an operator selects a desired number through a touch panel provided on the display, having touch sensors corresponding to the numeric keys.

2. Related Art

A conventional household electronically controlled sewing machine has a stitching unit having a sewing needle movable in a vertical direction and a needle thread catcher for stitching in cooperation with the needle, a driving unit for driving an embroidery frame on which a workpiece (e.g., cloth) is removably mounted, to move in two directions perpendicular to each other independently, a pattern data memory which stores several kinds of embroidery pattern data representing various objects to be stitched such as a vehicle, a flower and an animal therein, a display, a control panel and so on. When a desired embroidery pattern is displayed on the display and selected by an operator, the driving unit is controlled according to the selected embroidery pattern data so that the desired embroidery pattern is stitched on the workpiece mounted on the embroidery frame by cooperative operation of the driving unit and the stitching unit.

Recently, ROM cards which store many new embroidery patterns are sold separately from the embroidery sewing machines. The new embroidery patterns can be stitched on a blouse or trousers for children, for example, by inserting the ROM card externally into the embroidery sewing machine. For embroidery stitching using the ROM card, various pattern selection methods for selecting a desired embroidery pattern from many patterns appearing on the display are proposed.

U.S. Pat. No. 4,688,503 (JP-A-61-247491) discloses a pattern selection unit for an embroidery sewing machine. In the unit, ten numbers of 0–9 are arranged in a row within a frame located immediately above a laterally-elongated display. An operator of the sewing machine designates a desired two-digit or three-digit number by moving a mini-cursor appearing on the display using a leftward-moving key and a rightward-moving key so that the designated number is selected. An embroidery pattern corresponding to the selected number is stitched on a workpiece. This requires an extra space for arranging the numbers of 0–9. Further, to select an embroidery pattern, the operator has to press the leftward/rightward-moving keys several times according to the digits of the pattern number of the embroidery pattern. Thus, pattern selection operation is complicated and time-consuming.

JP-A-62-101283 discloses a sewing machine having an upper digit key and a lower digit key in the vicinity of a display. An operator selects a two-digit pattern number by using the upper and lower digit keys so that an embroidery pattern corresponding to the pattern number is selected and shown on the display. However, an operator also has to press the upper/lower digit keys several times to select the pattern number, resulting in a complicated pattern selection operation.

JP-B2-1-26317 discloses an electronically controlled sewing machine having ten numeric buttons representing numbers of 0–9 provided in the vicinity of a display. An operator selects a two-digit pattern number by using the numeric buttons so that an embroidery pattern corresponding to the pattern number is selected. However, an extra space for the numeric buttons is required, leading to increase in the size of the sewing machine and a high production cost.

U.S. Pat. No. 5,228,403 (JP-A-5-123470) discloses an embroidery sewing machine having a display on which a preset number (e.g., five) of embroidery patterns selected from entire stored embroidery patterns are collectively presented on the display in turn as a screen of the display changes. An operator proceeds to the next screen by pressing a next page key until a desired embroidery pattern appears on the display. However, the display needs to be enlarged to display several embroidery patterns simultaneously, resulting in a high production cost of the display. Further, the operator has to press the next page key several times until a desired embroidery pattern appears on the display; therefore, the pattern selection operation is complicated and time-consuming.

SUMMARY OF THE INVENTION

It is an object of the present invention to provide a sewing machine control having a display on which ten numeric keys representing numbers of 0–9 are displayed so that a pattern selection process is simplified.

According to the present invention, a sewing machine provided with a display has a numeric key display control unit for displaying ten numeric keys representing numbers 0–9 in a numeric key display area of the display. A touch panel having touch sensors corresponding to the numeric keys is provided in the numeric key display area of the display. A number corresponding to a desired embroidery pattern to be stitched or pattern information to be displayed can be selected by pressing the touch sensors so that the desired pattern or information is selected and displayed. The embroidery patterns are displayed on the display only after the touch panel is operated to select the numeric keys.

Preferably, the sewing machine has a pattern selection unit and a pattern data storing unit. The pattern selection unit selects a desired embroidery pattern to be stitched from a plurality of embroidery patterns stored in the pattern data storing unit, through the numeric keys and the touch panel displayed by the numeric key display unit. Thus, a pattern selection process is simplified, and the size of the sewing machine is reduced because the numeric keys are provided in the display.

Preferably, the sewing machine has a selected number display control unit for displaying the number selected through the touch panel in a number display area of the display, in a different way of display from that of numbers of the numeric keys. This enables an operator to readily distinguish the selected numbers from the numbers of the numeric keys.

Further, the selected numbers may be displayed in a size smaller than a size of the numbers of the numeric keys. The numeric keys are displayed in a larger space to facilitate key operation, and the selected numbers are readily recognized by an operator. Even when the number of digits of a selected number is increased to three, four or more, the selected number is fully displayed.

Further, the selected numbers may be displayed in reversed contrast with respect to the numeric keys. This also makes recognition of the selected numbers easier.

Preferably, the pattern data storing unit has an external memory which stores a plurality of embroidery patterns and is removably attached to the sewing machine. A desired embroidery pattern is readily selected from the embroidery patterns stored in the external memory by pressing the touch sensors of the touch panel in a short time.

BRIEF DESCRIPTION OF THE DRAWINGS

Additional objects and advantages of the present invention will be more readily apparent from the following detailed description of a preferred embodiment when taken together with the accompanying drawings, in which.

DETAILED DESCRIPTION OF THE PREFERRED EMBODIMENTS

The present invention is applied to an electronically controlled embroidery sewing machine having a removably mounted embroidery device by which various embroidery stitches can be sewn, for example.

Figure 1:
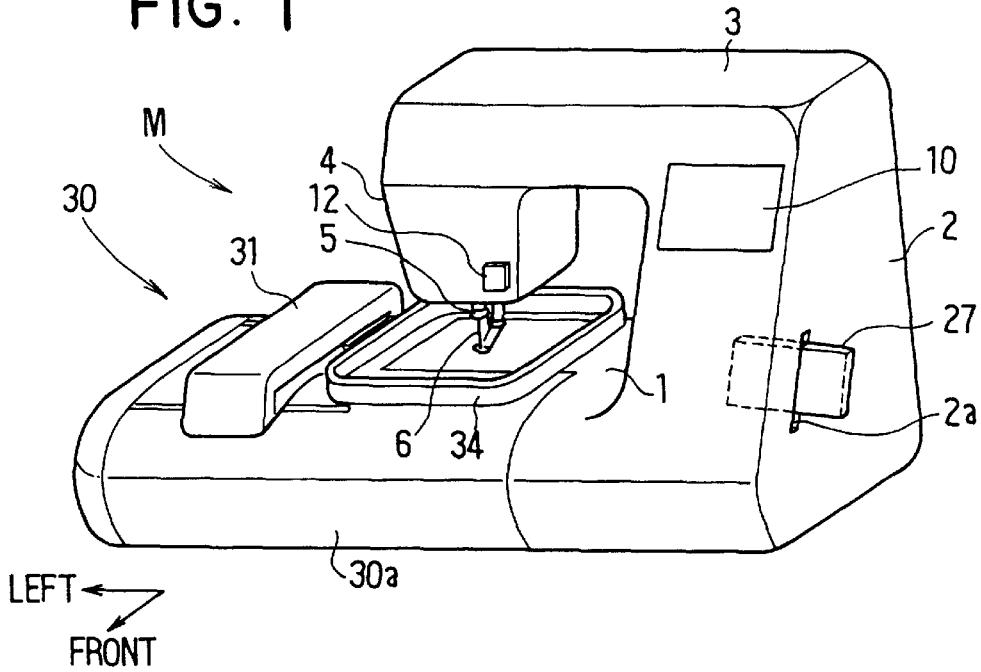
FIG. 1 is a schematic perspective view showing an electronically controlled embroidery sewing machine according to an embodiment of the present invention.

As shown in FIG. 1, an electronically controlled embroidery sewing machine M has a flat bed 1, a column 2 extending upwardly from a right end portion of the bed 1 and an arm 3 extending leftwardly from the top of the column 2 in to parallel with the bed 1.

Figure 2:
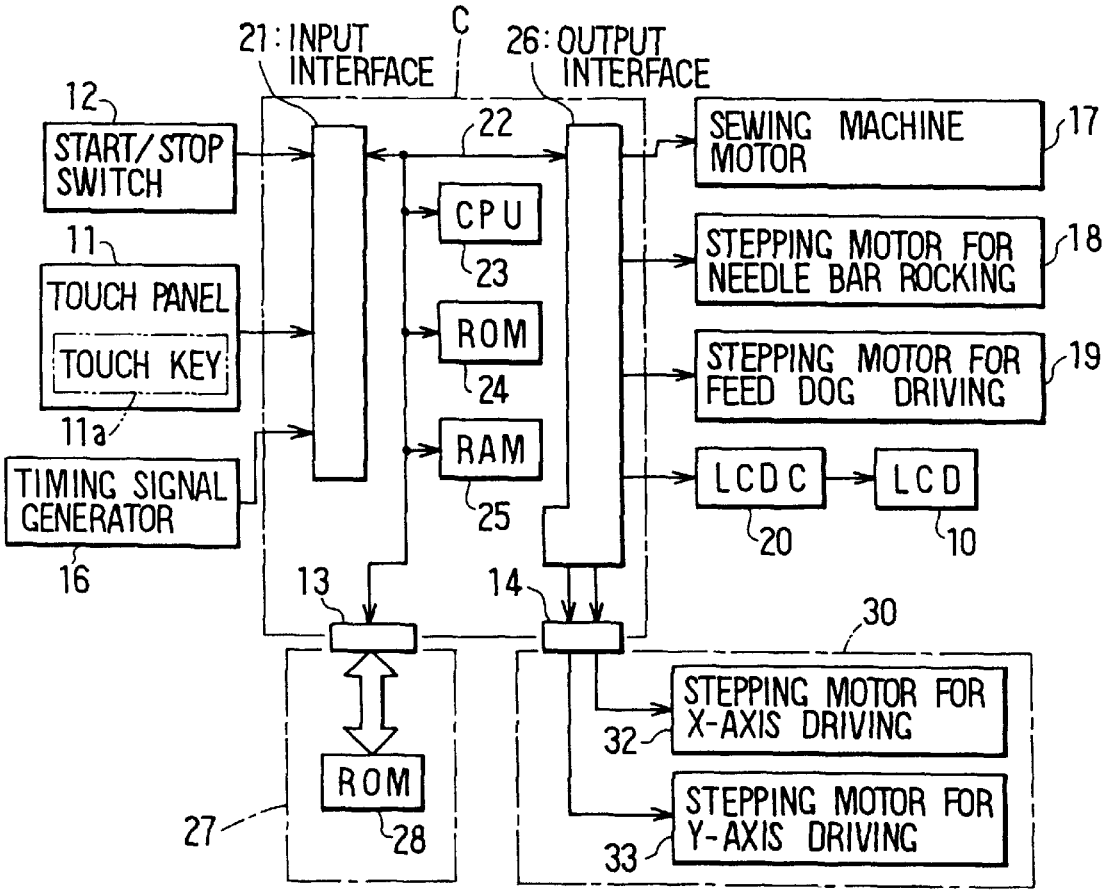
FIG. 2 is a block diagram of a control system of the embroidery sewing machine according to the embodiment.

The bed 1 is provided with a feed dog up/down moving mechanism (not shown) for moving a feed dog upwardly and downwardly, a feed dog back/forth moving mechanism (not shown) for moving a feed dog forwardly and backwardly and a needle thread catcher (e.g., horizontal type) which accommodates a bobbin and forms stitches in cooperation with a needle 6. The column 2 has a card slot 2*a* so that a ROM card 27 memorizing many kinds of embroidery pattern data is optionally inserted into the card slot 2*a* to be connected with a card connector 13 (FIG. 2). The arm 3 has a needle bar driving mechanism for moving a needle bar 5 upwardly and downwardly, a needle bar rocking mechanism (not shown) for rocking the needle bar 5 in a direction perpendicular to a workpiece feeding direction and a thread take-up lever driving mechanism (not shown) for moving a thread take-up lever (not shown) upwardly and downwardly in a timed relationship with the up-and-down movement of the needle bar 5. The needle 6 is mounted on the lower end of the needle bar 5.

As known in the art, the feed dog up/down moving mechanism, the needle bar driving mechanism and the thread take-up lever driving mechanism are driven by a sewing machine motor 17 (FIG. 2), the needle bar rocking mechanism is driven by a needle bar rocking stepping motor 18 (FIG. 2), and the feed dog back/forth moving mechanism is driven by a feed dog back/forth moving stepping motor 19 (FIG. 2).

An arm head 4 at the end of the arm 3 has a start/stop switch 12 for commanding the sewing machine M to start and stop sewing. A liquid crystal display 10 is attached to the front face of the arm 3. The display 10 shows various utility stitch and embroidery patterns, names of various functions and various error and guide messages. On the front face of the display 10, a touch panel having a plurality of touch sensors (touch keys) 11*a* made of transparent electrodes arranged in a matrix form is provided. Each of the touch keys 11*a* (FIG. 2) corresponds to each of the display positions of numeric keys representing numbers of 0–9, the embroidery patterns, the function names and so on. A desired embroidery pattern or function can be selected by pressing the touch key 11*a* corresponding to the numeric key, embroidery pattern or function.

A free bed portion called free arm is formed at the left end portion of the bed 1. An embroidery unit 30 is removably mounted on the free bed portion. The embroidery unit 30 has a case 30*a*, an embroidery frame 34 on which a workpiece W (e.g., cloth) is removably mounted and a frame case 31. The frame case 31 is integrated with a Y-direction driving mechanism for driving the embroidery frame 34 in the Y direction (i.e., back and forth direction). An X-direction driving mechanism is accommodated in the case 30*a*, for driving the frame case 31 including the Y-direction driving mechanism in the X-direction (i.e., left and right direction).

As shown in FIG. 2, the X-direction driving mechanism is driven by a first stepping motor 32, and the Y-direction driving mechanism is driven by a second stepping motor 33. When the embroidery unit 30 is mounted on the free bed portion, the first and second stepping motors 32, 33 are electrically connected to a control unit C of the sewing machine M through a connector 14. The first and second stepping motors 32, 33 are controlled by the control unit C so that the embroidery frame 34 and the workpiece W are driven to move in the X and Y directions independently for embroidery sewing.

The control unit C has an input interface 21, a computer having a CPU 23, a ROM 24 and a RAM 25, an output interface 26 and a bus 22 for connecting these parts 21 and 23–26. The input interface 21 is connected with the start/stop switch 12, the touch panel 11 and a timing signal generator 16 for detecting several rotation phases of a main shaft of the sewing machine M. The output interface 26 is connected with the sewing machine motor 17, the needle bar rocking stepping motor 18, the feed dog back/forth driving stepping motor 19, a display controller 20 (LCDC) for the display 10 (LCD) and the first and second stepping motors 32, 33 for the embroidery unit 30. Further, a ROM 28 in the ROM card 27 is connectable to the bus 22 through the card connector 13.

The ROM 24, which is a part of a pattern data storing unit of the sewing machine M, stores various control programs including a general control program for general utility stitching/display control, a pattern select/edit/stitching control program and a display information control program. The pattern select/edit/stitching control program is applied to both an editing process in which a desired size and location of an embroidery is edited through the display 10 and an embroidery stitching process in which a selected embroidery pattern is embroidered on the workpiece W.

Figure 3:
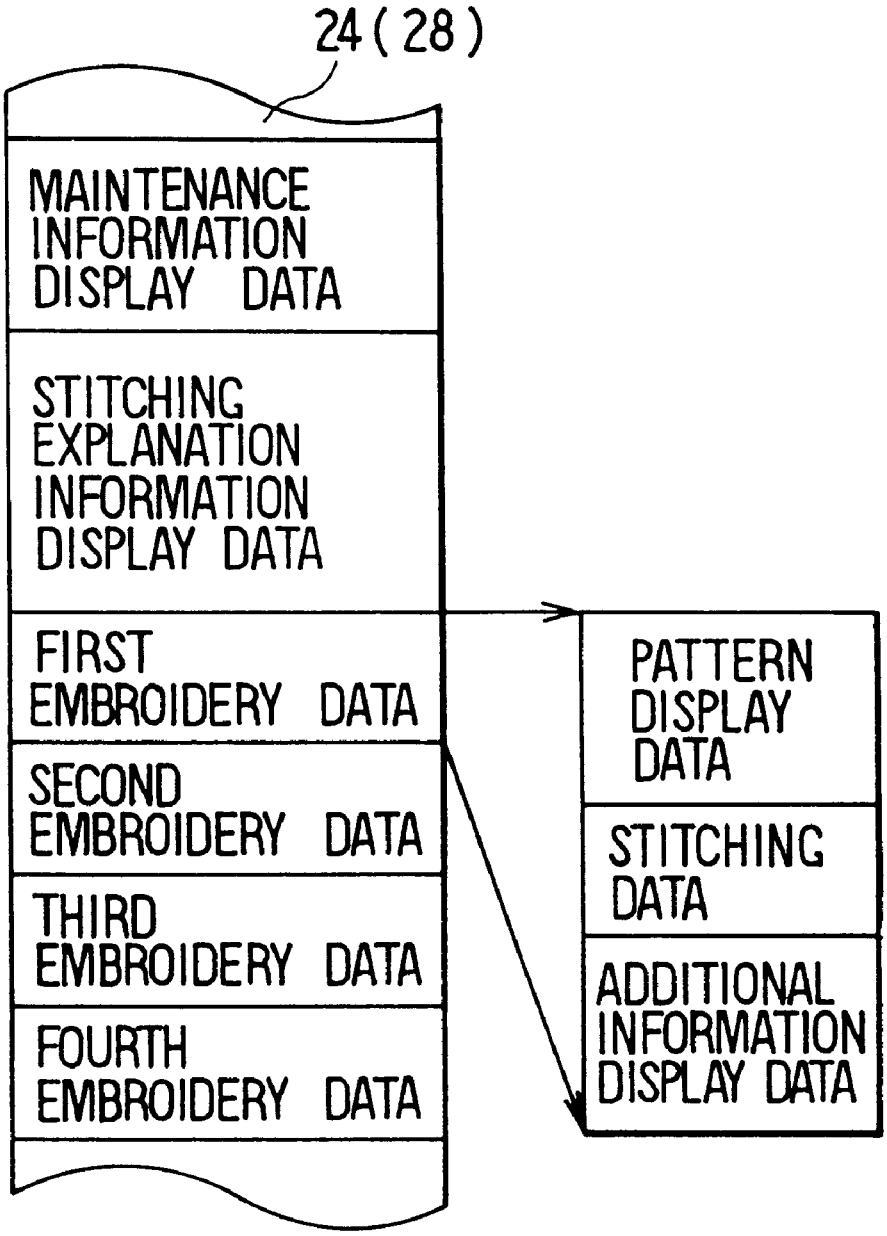
FIG. 3 is an explanatory diagram showing a data structure of various data stored in a ROM integrated in the sewing machine or in a ROM of a ROM card according to the embodiment.

Further, as shown in FIG. 3, the ROM 24 stores display/stitching data corresponding to each of letter/character patterns (e.g., numerals and alphabets) and utility stitch patterns with a pattern number, maintenance information display data to be displayed in one screen and stitching explanation information display data to be displayed in several screens. The maintenance information shows methods of maintenance and temporary repair of the embroidery sewing machine M. The embroidery pattern information shows sewing methods of utility stitch patterns and embroidery patterns.

Further, as shown in FIG. 3, the ROM 24 stores data of many embroidery patterns (i.e., first embroidery pattern, second embroidery pattern and so on) which are used relatively frequently. The embroidery pattern data are classified into several groups according to the kind of the embroidery pattern and stored with a pattern number.

Several number of external ROM cards are prepared for the embroidery sewing machine M. For instance, the ROM 28 in the ROM card 27 stores data of embroidery patterns (i.e., first embroidery pattern, second embroidery pattern and so on) which are used relatively less frequently as well as data of embroidery patterns representing letters/characters, graphics, marks and characters (e.g., celebrities, animals and cartoon robots appearing on TV or films). These embroidery patterns are also classified into several groups according to the kind of the embroidery pattern and stored in the ROM 28 with a pattern number in the same manner as in the ROM 24.

The utility pattern data and the embroidery pattern data have the same data structure. Therefore, the first embroidery pattern data will be described as an example. As shown in FIG. 3, the first embroidery pattern data stores pattern display data for displaying embroidery patterns, stitching data including several needle stitch point data, and additional information display data for displaying various additional information related to the first embroidery pattern data. The additional information includes various function names to be displayed on the display 10 as the need arises, and ten numeric keys representing numbers of 0–9. Each of the three kinds of data is separately stored in the first embroidery pattern data.

The RAM 25 is provided with memories such as flags, pointers, counters, registers and buffer, which are necessary for various controls.

Figure 4:
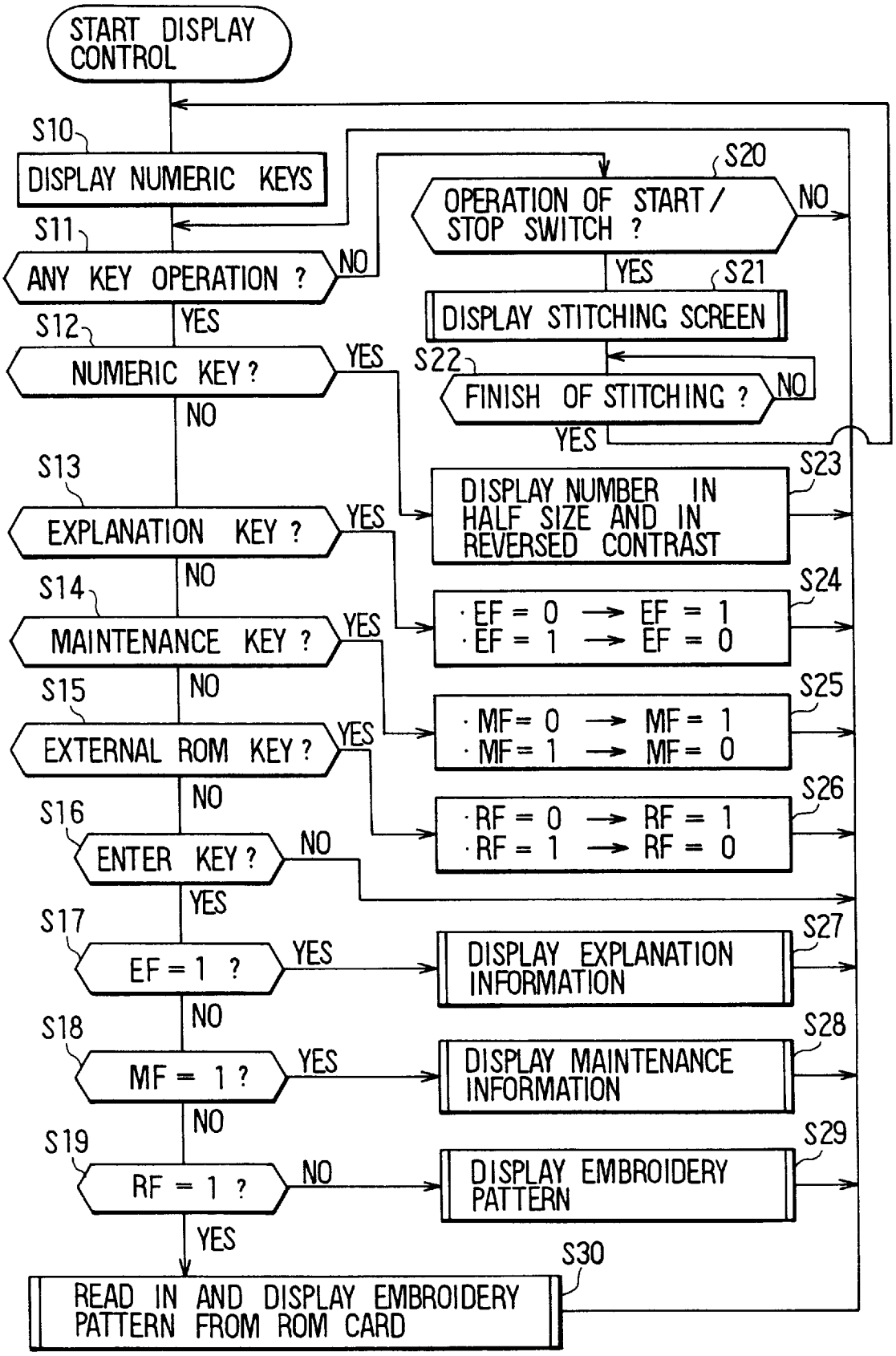
FIG. 4 is a flow chart showing a routine for display control according to the embodiment.

Next, the information display control performed by the control unit C, particularly, by the CPU 23, based on the programmed routine shown in FIG. 4 will be described.

Figure 5:
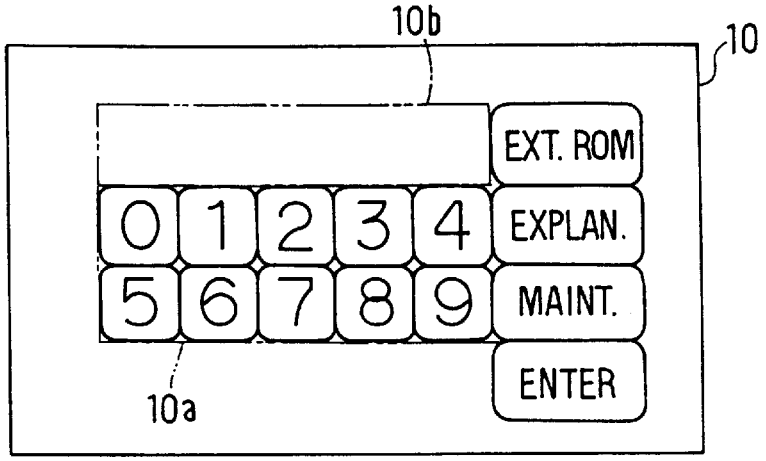
FIG. 5 is a schematic view showing a display of the sewing machine presenting numeric keys according to the embodiment.

When the control unit C starts to operate, ten numeric keys representing numbers of 0–9 are displayed in a numeric key display area 10*a* of the display 10 at step S10, according to the additional information data stored in the ROM 24. For example, as shown in FIG. 5, the ten numeric keys with numbers 0–9 appear in the numeric key display area 10*a* of the display 10 in two rows. A number display area 10*b* where numbers selected through the numeric keys are displayed is provided immediately above the numeric key display area 10*a*.

Figure 6:
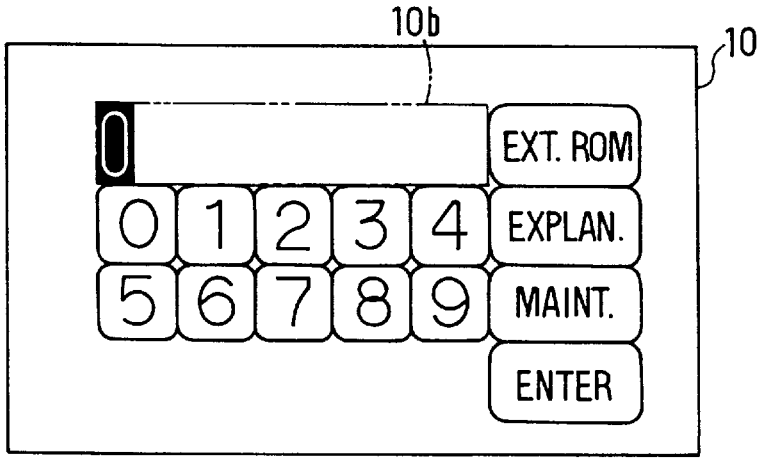
FIG. 6 is a schematic view showing the display on which a selected number "0" appears according to the embodiment.

When it is determined at step S11 that any touch key 11*a* is pressed, and at step S12 that the pressed touch key 11*a* corresponds to a numeric key, the number of the pressed numeric key is selected, and the selected number is displayed in the number display area 10*b* in half-size and in reversed contrast at step S23. That is, the displayed numbers 0–9 are compressed to be half-sized, and the reversed dot data in which all dot data of 1 and 0 are reversed are compiled to be displayed. For example, as shown in FIG. 6, when "0" is selected, "0" is compressed to be half-sized and is displayed in reversed contrast at the left end of the number display area 10*b*.

When it is determined that at step S11 any touch key 11*a* is pressed, at step S12 that the pressed touch key 11*a* does not correspond to the numeric key, and at step S13 that the pressed touch key 11*a* corresponds to an explanation key, an explanation information display flag EF is reversed at step S24. That is, it is set if it has been reset to zero, and is reset to zero if it has been set.

When it is determined at step S11 that any touch key 11*a* is pressed, at step S12 that the pressed touch key 11*a* does not correspond to the numeric key, at step S13 that the pressed touch key 11*a* does not correspond to the explanation key, and at step S14 that the pressed touch key 11*a* corresponds to a maintenance key, a maintenance information display flag MF is reversed at step S25. That is, it is set if it has been reset to zero, and is reset to zero if it has been set.

When it is determined at step S11 that any touch key 11*a* is pressed, at step S12 that the pressed touch key 11*a* does not correspond to the numeric key, at step S13 that the pressed touch key 11*a* does not correspond to the explanation key, and at step S14 that the pressed touch key 11*a* does not correspond to a maintenance key, and at step S15 that the pressed touch key 11*a* corresponds to an external ROM key, an external ROM flag RF is reversed at step S26. That is, it is set if it has been reset to zero, and is reset to zero if it has been set.

Figure 7:
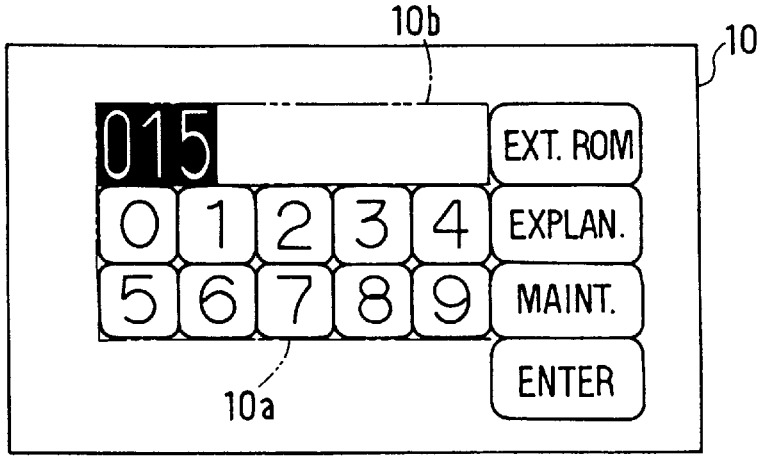
FIG. 7 is a schematic view showing the display on which a selected number "015" appears according to the embodiment.
Figure 8:
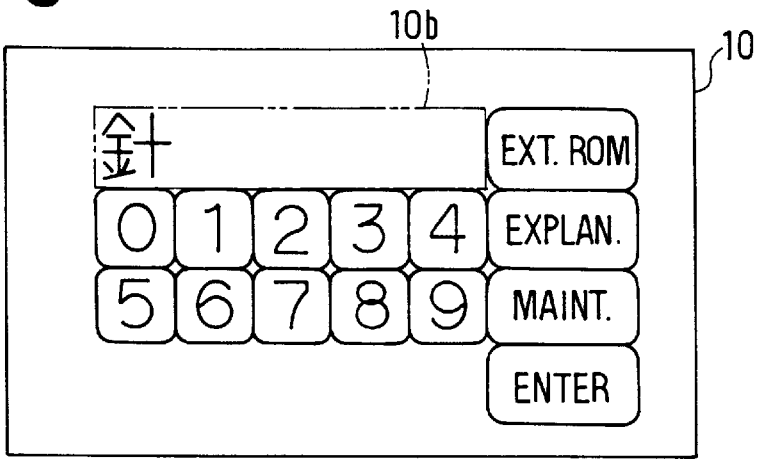
FIG. 8 is a schematic view showing the display on which a selected Chinese character appears according to the embodiment.

As shown in FIG. 7, when a three-digit number "015", is selected for designation of a pattern, and it is determined at step S11 that any touch key 11*a* is pressed, at steps S12, S13, S14, S15 that the pressed touch key 11*a* corresponds to neither the numeric key, the explanation key, the maintenance key nor the external ROM key, at step S16 that the pressed touch key 11*a* corresponds to an enter key, and at steps S17, S18, S19 that none of the explanation information display flag EF, the maintenance information display flag MF and the external ROM flag RF is set, display data of the pattern designated by the three-digit number "015" are read from the ROM 24 to be displayed in the number display area 10*b* of the display 10 at step S29. For example, as shown in FIG. 8, the pattern designated by "015", a Chinese character 針 (needle), appears in the number display area 10*b*, replacing "015".

When the enter key is pressed and it is determined at steps S17, S18 that neither the explanation information display flag EF nor the maintenance information display flag MF are set, and at step S19 that the external ROM flag RF is set, display data of the pattern designated by a three-digit number are read from the ROM 28 of the ROM card 27 to be displayed in the number display area 10*b* of the display 10 at step S30.

Figure 9:
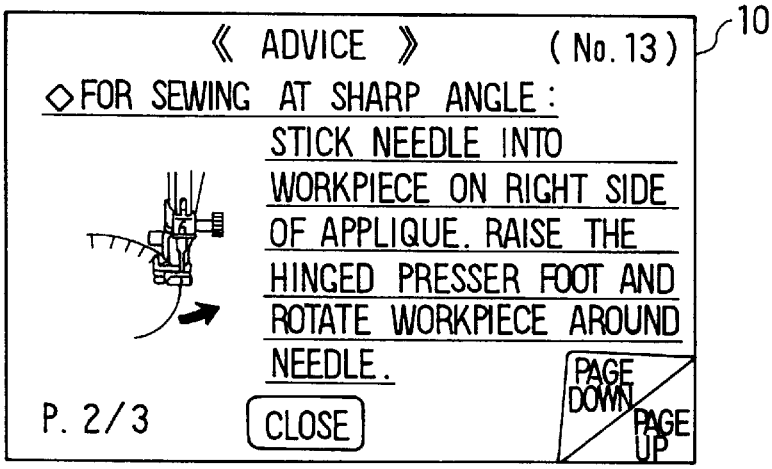
FIG. 9 is a schematic view showing the display presenting a selected useful information according to the embodiment.

When the enter key is pressed and it is determined at step S17 that the explanation information display flag EF is set, display data of the explanation information designated by a three-digit number is displayed on the display 10 at step S27. For example, as shown in FIG. 9, 13th useful information (advice) corresponding to a three-digit number "013" is displayed.

Figure 10:
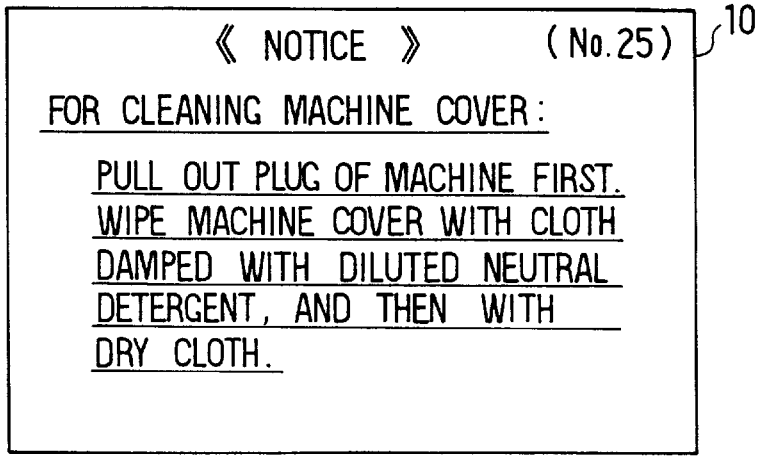
FIG. 10 is a schematic view showing the display presenting a selected maintenance information according to the embodiment.

When the enter key is pressed and it is determined at step S17 that neither the explanation information display flag EF is not set, and at step S18 that the maintenance information display flag MF is set, display data of the maintenance information designated by a three-digit number appear on the display 10 at step S28. For example, as shown in FIG. 10, 25th maintenance information (notice) about cleaning, corresponding to a three-digit number "025" is displayed.

When one or more patterns are selected to be stitched and it is determined at step S11 that no touch key 11*a* is pressed and at step S20 that the start/stop switch 12 is pressed, an EMBROIDERY screen in which a selected embroidery pattern or the like is displayed during embroidery stitching appears on the display 10 at step S21. When it is determined at step S22 that the embroidery stitching is completed, the control sequence returns to step S10 and steps S10–S30 are repeatedly performed.

According to the above embodiment, the ROM 24 in the embroidery sewing machine M stores the additional information display data which stores the numeric key display data for displaying the ten numeric keys representing numbers 0–9 in the numeric key display area 10*a* of the display 10, while the display 10 is provided with the touch panel 11 having several touch keys 11*a*. Therefore, a desired embroidery pattern, maintenance information or stitching explanation information is selected by entering a number corresponding to the desired pattern/information using the touch keys 11*a* corresponding to the numeric keys. Thus, the selection operation of the desired embroidery pattern to be stitched or the desired information to be displayed is simplified, improving an operability of the sewing machine M. Further, the size and cost of the sewing machine M is reduced because extra numeric buttons and an extra space for the buttons are not required.

Further, in the embodiment, the numbers selected through the touch panel 11 are displayed in reversed contrast in the number display area 10*b*, not in the numeric key display area 10*a*, while being compressed to be half-sized. Therefore, the space for displaying the numeric keys are increased, thereby facilitating the operator to touch the numeric keys, and the selected numbers are readily recognized due to half-sized and reversed-contrast display. Further, even when the number of the digits of the selected number is increased to three or four, the selected number is fully displayed.

Furthermore, even when an embroidery pattern to be stitched is selected from many (e.g., 90–100) embroidery patterns stored in the ROM 28 in the ROM card 27, the embroidery pattern is readily selected in a short time by pressing the touch keys 11*a*.

The numeric keys, instead of the selected numbers, may be displayed in reversed contrast. The selected numbers may blink while being displayed, or may be displayed slantingly. Further, when the pattern data is made of solely the stitching data and does not include the pattern display data, the pattern display data may be compiled by processing the stitching data.

Further, the maintenance information and the stitching explanation information may be stored in the ROM 28 of the ROM card 27. The pattern data may be stored in a magnetic disk, which is removably attached to a FDD of the control unit C, instead of the ROM card 27. The pattern data may be stored in a compact disk, a CD-ROM or a magnetic laser disk.

Although the present invention has been fully described in connection with preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. An embroidery sewing machine comprising:

a pattern data storing unit for storing pattern information data for a plurality of embroidery patterns, each of said pattern information data being associated with a number corresponding to each of said plurality of embroidery patterns;

a display unit for displaying said embroidery patterns according to said pattern information data;

an embroidery stitching unit for stitching said embroidery patterns on a workpiece;

a stitching control unit for controlling and driving said embroidery stitching unit;

a numeric key display control unit for displaying ten numeric keys each representing a numeric character, in a numeric key display area of said display unit;

a touch panel disposed in said numeric key display area of said display unit and having ten touch sensors corresponding to said numeric keys; and a pattern selecting unit for selecting one of said embroidery patterns corresponding to a number selected by said displayed numeric keys operated through said touch panel;

wherein said embroidery patterns are displayed only after said touch panel is operated to select said numeric keys.

2. An embroidery sewing machine according to claim 1, wherein said number is displayed in a number display area of said display unit in a different was of display from that of said numeric keys in said numeric key display area.

3. An embroidery sewing machine according to claim 1, wherein said pattern selecting unit includes a selected number display unit for displaying said number in a number display area of said display unit, at a different location and in a different way of display from that of said numeric keys in said numeric key display area.

4. An embroidery sewing machine according to claim 3, wherein said number is displayed in said number display area in a size smaller than that of said numeric character of said numeric keys in said numeric key display area.

5. An embroidery sewing machine according to claim 3, wherein said number is displayed in reversed contrast with respect to said numeric character of said numeric keys.

6. An embroidery sewing machine according to claim 1, wherein said pattern data storing unit includes a removable external memory which stores said plurality of embroidery pattern data.

7. An embroidery sewing machine according to claim 1, wherein the number of digits of said number is at least two.

8. An embroidery sewing machine according to claim 1, wherein said numeric keys are displayed in two rows in said numeric key display area of said display unit.

9. An embroidery sewing machine according to claim 1, wherein said number is displayed, followed by one of said embroidery patterns corresponding to said selected number, in a number display area of said display unit at a location near said numeric key display area.

10. An embroidery sewing machine according to claim 9, wherein said number display area is located immediately above said numeric key display area.

11. An embroidery pattern selection control method for a sewing machine having a display unit and a pattern data storing unit, comprising the steps of:

displaying a plurality of numeric keys on a first display area of said display unit;

selecting a number corresponding to an embroidery pattern to be stitched through said displayed plurality of numeric keys;

displaying said selected number on a second display area of said display unit in a different display mode from that of said numeric keys;

reading in said embroidery pattern corresponding to said selected and displayed number from a plurality of embroidery patterns stored in said pattern data storing unit; and displaying said embroidery pattern in said second display area of said display unit in place of said selected and displayed number.

12. An embroidery pattern selection control method according to claim 11, wherein said reading step is enabled when an enter key displayed on said display unit is pressed.

13. An embroidery pattern selection control method according to claim 11, wherein the number of digits of said selected and displayed number is at least two.

14. An embroidery pattern selection control method according to claim 11, wherein the number of said displayed numeric keys is ten.

15. An embroidery pattern selection control method according to claim 11, wherein said second display area is positioned at a location near said first display area.

16. An embroidery pattern selection control method according to claim 11, wherein said second display area is smaller than said first display area.

17. An embroidery pattern selection control method according to claim 11, wherein said selected number is displayed in half size and in reversed contrast relative to said displayed numeric keys.

18. An embroidery pattern selection control method according to claim 11, further comprising the step of:

displaying other information on said first and second display areas in place of said displayed numeric keys, said selected and displayed number and said displayed embroidery pattern.

19. An embroidery pattern selection control apparatus for a sewing machine having a display unit and a pattern data storing unit, the apparatus comprising:

means for displaying a plurality of numeric keys on a first display area of said display unit;

means for selecting a number corresponding to an embroidery pattern to be stitched through said displayed plurality of numeric keys;

means for displaying said selected number on a second display area of said display unit in a different display mode from that of said numeric keys;

means for reading in said embroidery pattern corresponding to said selected and displayed number from a plurality of embroidery patterns stored in said pattern data storing unit; and means for displaying said embroidery pattern in said second display area of said display unit in place of said selected and displayed number.

20. An embroidery pattern selection control apparatus according to claim 19, wherein said reading means is enabled to execute a reading operation thereof when an enter key displayed on said display unit is pressed.

* * * * *